United States Patent [19]

Hilgarth

[11] Patent Number: 4,837,884

[45] Date of Patent: Jun. 13, 1989

[54] PROCESS FOR FILLING WITH FOAM THE INNER BOOT OF SKIBOOTS AND SKIBOOT PRODUCED ACCORDING TO THE PROCESS

[75] Inventor: Kurt Hilgarth, Graz, Austria

[73] Assignee: Skischuhfabrik Dynafit Gesellschaft GmbH, Graz, Austria

[21] Appl. No.: 93,792

[22] Filed: Sep. 8, 1987

[30] Foreign Application Priority Data

Oct. 9, 1986 [AT] Austria ..... 2692/86

[51] Int. Cl.[4] ..... A43B 5/04; A43B 7/14

[52] U.S. Cl. ..... 12/142 P; 36/71; 36/93; 36/119

[58] Field of Search ..... 36/119, 71, 88, 93, 36/117; 12/142 P, 142 N; 264/223, 244

[56] References Cited

U.S. PATENT DOCUMENTS

| | | | |
|---|---|---|---|
| 3,581,412 | 6/1971 | Dalebout | 36/119 |
| 3,736,612 | 6/1973 | Check et al. | 12/142 P |
| 3,769,392 | 10/1973 | Tessaro | 36/119 X |
| 3,834,044 | 9/1974 | McAusland et al. | 36/119 |
| 3,876,746 | 4/1975 | Hanson | 36/119 X |
| 3,896,202 | 7/1975 | Palau | 36/93 X |

FOREIGN PATENT DOCUMENTS

| | | | |
|---|---|---|---|
| 265910 | 10/1968 | Austria . | |
| 363354 | 7/1981 | Austria . | |
| 364279 | 10/1981 | Austria . | |
| 0066133 | 12/1982 | European Pat. Off. | 36/119 |
| 2026062 | 9/1970 | France | 36/119 |

OTHER PUBLICATIONS

WO87/01566, 3/26/1987, WIPO Dynafit.

*Primary Examiner*—James K. Chi

*Attorney, Agent, or Firm*—Fleit, Jacobson, Cohn & Price

[57] ABSTRACT

Process for filling with foam an inner boot of skiing boot in which the foam or the material to be expanded into a foam is introduced in the lower boot region. The foam or material is directed from the instep region towards the lower heel end and is thus introduced into the skiing boot until it emerges from the heel end. This causes the lateral front region of the inner boot to be filled with foam asymmetrically in relation to the longitudinal central plane.

10 Claims; 2 Drawing Sheets

PROCESS FOR FILLING WITH FOAM THE INNER BOOT OF SKIBOOTS AND SKIBOOT PRODUCED ACCORDING TO THE PROCESS

BACKGROUND OF THE INVENTION AND PRIOR ART

The invention relates to a process for filling with foam an inner boot of skiing boots in which the foam or respectively the expandable foam material is injected in the lower boot region, preferably in the instep region, being advantageously directed towards the lower heel end until it emerges at the heel end.

The invention furthermore relates to an inner boot produced according to this process.

in prior art processes of this type the foam material fills two cavities which are symmetrical about the central longitudinal axis. Because the inner boot on the one hand transmits the movement of the foot of the skier to the ski and must accordingly offer a secure support to the foot in the outer boot for that purpose, but must on the other hand provide comfort to the foot and accordingly protect the foot against pressure spots, the foam filling of the inner boot plays an important part for complying with the task thereby presented. Prior art skiing boots have failed to attain optimised running and walking properties.

GENERAL DESCRIPTION OF THE INVENTION

Surprisingly it has now been found that the stated objects are attained in an optimal fashion if according to the invention the lateral front portion of the inner boot is filled with foam asymmetrically in two cavities which in respect of the longitudinal central plane of the inner boot are asymmetrically arranged. In this context it is advantageous according to a further feature of the invention if the cavity on the inside extends further towards the boot tip than the outwardly directed chamber.

According to the invention the inner boot manufactured according to the process of the invention, comprises two seprate asymmetrical cavities, being asymmetrical about the vertical longitudinal central plane of the skiing boot or respectively the inner boot and being separated by a space filled with its own cushioning means and extending along the bi-step, the space filled with its own cushioning means extending between the asymmetrical cavities and the boot tip and being particularly on the sole side shorter along the inward side of the boot than along the outward side of the boot.

BRIEF DESCRIPTION OF THE DRAWINGS

In the drawing a working example of the inner boot according to the invention is illustrated. There is shown in FIG. 1 a cross-section of the inner boot jointly with the outer boot, FIG. 2 a plan view of the inner boot and FIG. 3 a rear elevation thereof.

DESCRIPTION OF SPECIFIC EMBODIMENTS

Figure 1:
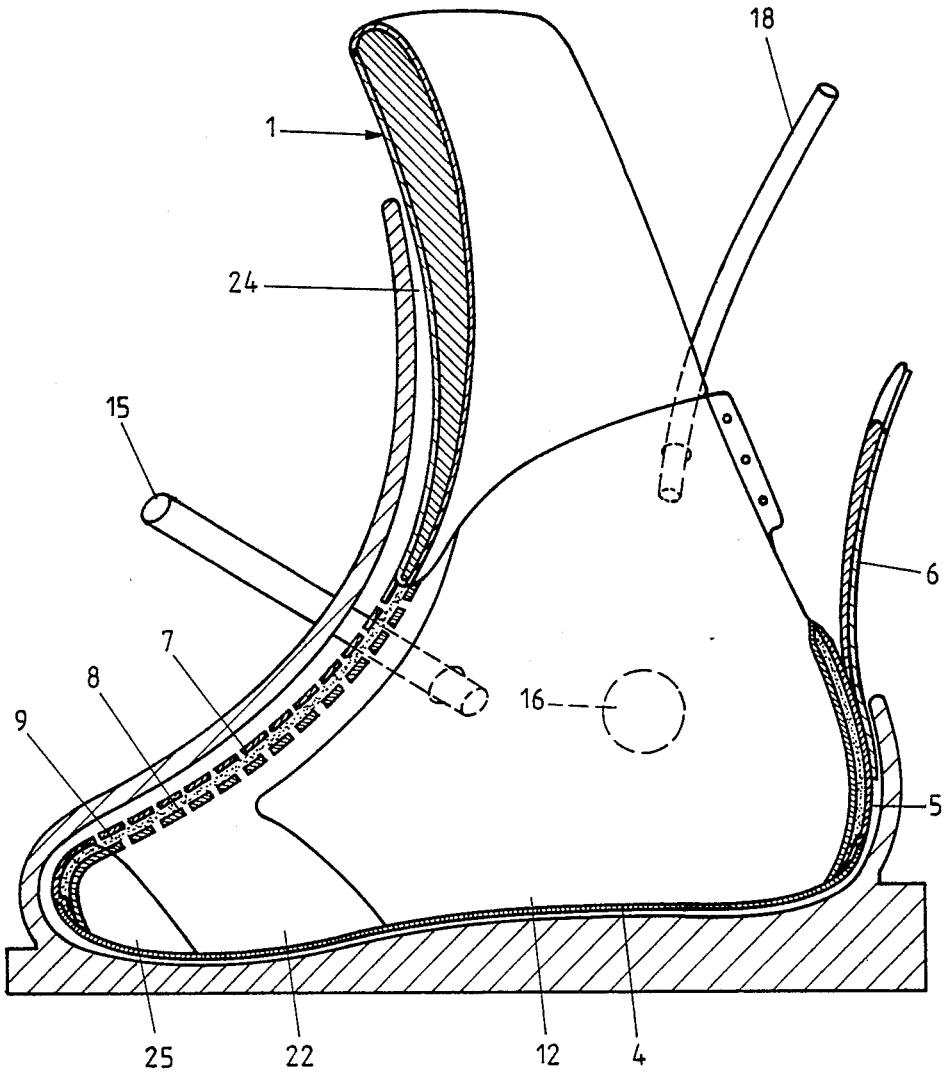
Figure 2:
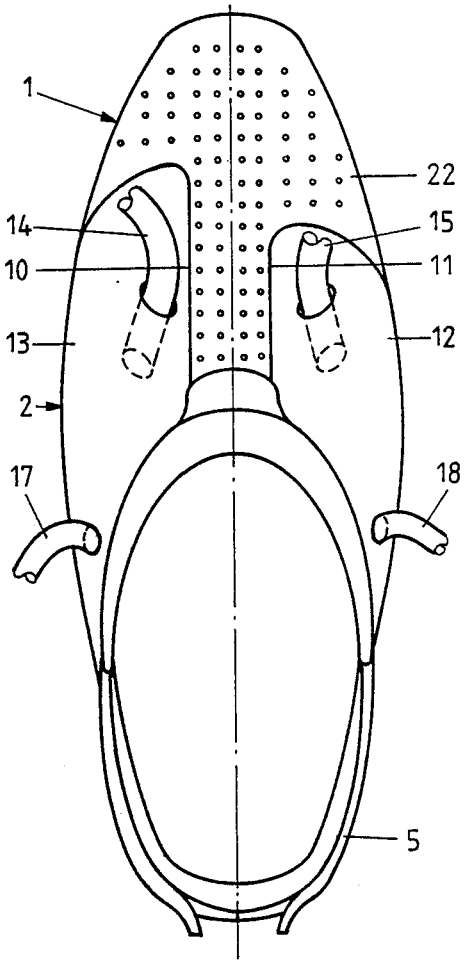
Figure 3:
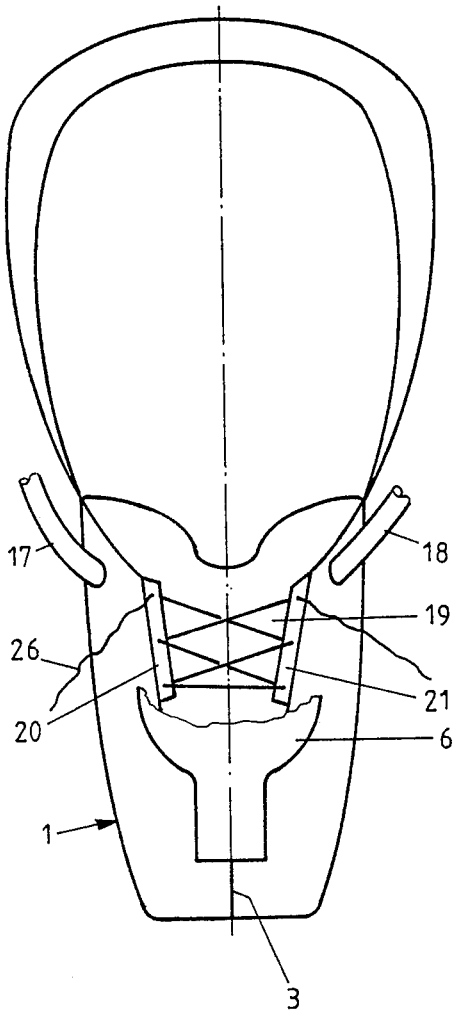

The inner boot, denoted as 1, comprises a blanked portion 2 covering the instep, the side portions and the ankle portion of the foot and which, as shown in FIG. 3, is connected in the lower part of the heel by a seam 3 to a sheel 5 of the inner boot, the shell being connected on the bottom side to a sole 4, e.g. by adhesive action or sewing. For the remainder the shell 5 is open on the heel side and covered by a lined flap 6 which may be fixed either to the inner boot or to the outer boot. The blanked out portion 2, as will be seen from FIG. 1, is formed of 3 layers, more particularly an outer layer followed by a foam- and airtight layer 7,8, e.g. of plastics and an inner thermally insulating layer 9. The two chambers 12 and 13 respectively are each limited by a seam 10 and 11 respectively on both sides of the longitudinal central plane of the inner boot, of which chambers that one, 12, which is to be on the outer side of the skiboot is shorter, viewed towards the skiing boot tip than the other, 13, which is positioned on the inner side. For the introduction of the foam, one hose each 14 and 15 respectively, directed towards the heel of the foot in such a manner that the foam introduced in situ first enters into the heel region, where the strongest cushioning effect is desired, enters into each of the two cavities 12,13 ahead of the ankle denoted as 16. In order to discharge excess foam after the cavities 12,13 have been filled, the latter are entered on both sides of the upper corner of the chambers 12,13 behind the ankle by a tube 17 or 18 respectively. As soon as the foam has emerged from both tubes for some time it will be certain that both cavities have been filled adequately, whereupon the hoses 14,15 and 17,18 are cut off.

The inner boot according to the invention is intended primarily for skiing boots which are to be entered from the heel end. For that purpose the shell 5 is open on the heel side by way of the seam 3 and forms a cup-shaped intermediate cavity 19 which is adjoined by two mutually opposing flaps 20,21 starting from the shell 5, which have been provided for fitting the boot string 26 for closing the inner boot 1 after the skier has entered into the boot.

Between the two cavities 12,13 a longitudinal cavity 22 which is not entered by the foam material is provided above the instep of the foot and is filled with an air-and vapour-pervious material, affording a means for ventilating the interior of the boot, for which purpose the two layers 7,8 in that region are provided with a perforation which, subject to the layer 9 being air pervious, permit venting through the gap 24 between the inner boot and the outer boot. At the toe end of the inner boot the chamber 22 expands laterally so that it extends to the sole and into the space between the cavities 12,13 at the one end and the boot tip at the other end.

A collar 25 for covering the front of the foot is provided, which is connected by sewing to the shell 5 and has its own lining.

The description of the specific examples should be read with the general description and with the claims filed herewith to constitute the complete disclosure of the invention.

What we claim is:

1. A process for filling an inner boot of a ski boot with a foam material, comprising the steps of:

establishing two cavities on opposite lateral sides of an inner boot of a ski boot such that one of said cavities is located on an inner side of the inner boot and the other of said cavities is located on an outer side of the inner boot, said two cavities being asymmetrical with respect to a vertical longitudinal central plane of the inner boot in that one of the cavities extends further toward the tip of the inner boot than the other cavity, and an opening into the front portion of each of said cavities and at least one opening from the heel portions of the cavities;

introducing an expandable foam material into each of said cavities by injecting said expandable foam material through the openings in the front portons of the cavities, said foam material being directed toward the heel portions of the cavities, until the expandable foam emerges from the opening in the heel portions, thereby filling said cavities with expandable foam material; and expanding said expandable foam material to produce expanded foam material completely filling said cavities.

2. Process according to claim 1, wherein the cavity on the inner side of the inner boot extends further towards a tip of the inner boot than the cavity on the outer side of the inner boot.

3. An inner boot of a ski boot, comprising an inner boot body having a tip portion and a heel end and defining two cavities disposed on opposite lateral sides thereof with one of said cavities located on an inner side of the inner boot and the other of said cavities located on an outer side of the inner boot, said two cavities being asymmetrical with respect to a vertical longitudinal central plane of the inner boot in that one of said cavities extends further toward the tip portion of the inner boot body than the other cavity, said cavities being filled with an expanded foam material.

4. An inner boot of claim 3, wherein said two cavities are separated from one another by a space filled with a cushioning means, which space extends between the front portions of the two cavities around the tip of the inner boot body.

5. Inner boot according to claim 3, wherein a gap is formed at the heel end of said inner boot between the heel portions of said cavities, and said inner boot body further comprises a connection bridging said gap.

6. Inner boot according to claim 5, wherein the connection is a boot string connection.

7. Inner boot according to claim 5, wherein said gap has a cup-shaped configuration and a bordered by flaps for accommodating a boot string means.

8. Inner boot according to claim 3, further comprising a longitudinal cavity between the front portions of the cavities and the tip portion of the inner boot body, said longitudinal cavity being enclosed by walls of a vapour- and air-pervious material and filled with a vapour- and air-pervious filling material.

9. A ski boot comprising an inner boot according to claim 3 in combination with an outer boot.

10. An inner boot as defined in claim 3, wherein the cavity on the inner side of the inner boot body extends further towards the tip portion of the inner boot body than the cavity on the outer side of the inner boot body.

* * * * *